US010227194B2

(12) United States Patent
Fujioka

(10) Patent No.: US 10,227,194 B2
(45) Date of Patent: Mar. 12, 2019

(54) SHEET CONVEYOR AND IMAGE FORMING APPARATUS

(71) Applicant: Brother Kogyo Kabushiki Kaisha, Nagoya-shi, Aichi-ken (JP)

(72) Inventor: Michio Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/892,615

(22) Filed: Feb. 9, 2018

(65) Prior Publication Data

US 2018/0273327 A1 Sep. 27, 2018

(30) Foreign Application Priority Data

Mar. 22, 2017 (JP) ..... 2017-056513

(51) Int. Cl.
*B65H 3/34* (2006.01)
*B65H 9/20* (2006.01)
(Continued)

(52) U.S. Cl.
CPC ..... *B65H 3/34* (2013.01); *B65H 1/04* (2013.01); *B65H 3/0684* (2013.01); *B65H 7/02* (2013.01); *B65H 7/20* (2013.01); *B65H 9/00* (2013.01); *B65H 9/06* (2013.01); *B65H 9/20* (2013.01); *B65H 1/26* (2013.01); *B65H 9/006* (2013.01); *B65H 2405/324* (2013.01); *B65H 2407/21* (2013.01); *B65H 2511/11* (2013.01); *B65H 2513/50* (2013.01); *B65H 2553/612* (2013.01); *B65H 2553/82* (2013.01);
(Continued)

(58) Field of Classification Search
CPC ... B65H 9/20; B65H 9/00; B65H 9/06; B65H 3/34; B65H 2553/82; B65H 2553/80; B65H 2553/822
See application file for complete search history.

(56) References Cited

U.S. PATENT DOCUMENTS 7,717,415 B2 5/2010 Kim et al.
7,775,518 B2 * 8/2010 Kondo ..... B65H 7/02 271/227
(Continued)

FOREIGN PATENT DOCUMENTS

JP H02-127349 A 5/1990
JP H05-132188 A 5/1993
JP 2009-280343 A 12/2009

*Primary Examiner* — Patrick Cicchino
(74) *Attorney, Agent, or Firm* — Banner & Witcoff, Ltd.

(57) ABSTRACT

In a sheet conveyor, a stopper piece of a sheet stopper temporarily stops a sheet supported on a sheet tray, and a pickup roller conveys the sheet from the sheet tray in a sheet conveying direction. A first sheet sensor disposed upstream of a registration roller and downstream of the stopper piece in the sheet conveying direction detects a leading edge of the sheet, and a second sheet sensor disposed downstream of the registration roller detects the leading edge of the sheet. A first contact member of the first sheet sensor receives the leading edge of the sheet. A second contact member of the second sheet sensor receives the leading edge of the sheet. The stopper piece, the first contact member, and the second contact member are offset from each other in a direction perpendicular to the sheet conveying direction and unaligned with each other in the sheet conveying direction.

12 Claims, 10 Drawing Sheets

(51) Int. Cl.

| | |
|---|---|
| ***B65H 9/06*** | (2006.01) |
| ***B65H 9/00*** | (2006.01) |
| ***B65H 7/20*** | (2006.01) |
| ***B65H 3/06*** | (2006.01) |
| ***B65H 1/04*** | (2006.01) |
| ***B65H 7/02*** | (2006.01) |
| *B65H 1/26* | (2006.01) |

(52) U.S. Cl.
CPC ..... *B65H 2553/822* (2013.01); *B65H 2701/1311* (2013.01); *B65H 2701/1313* (2013.01); *B65H 2801/06* (2013.01)

(56) References Cited

U.S. PATENT DOCUMENTS

| | | | | |
|---|---|---|---|---|
| 8,641,035 | B2 * | 2/2014 | Kambayashi | B65H 3/0607 271/121 |
| 8,827,266 | B2 * | 9/2014 | Umi | B65H 3/063 271/258.01 |
| 8,910,938 | B2 * | 12/2014 | Sunohara | B65H 43/02 271/258.01 |
| 9,221,637 | B2 * | 12/2015 | Murata | B65H 3/0669 |
| 9,266,691 | B2 * | 2/2016 | Morimoto | B65H 1/26 |
| 9,617,093 | B2 * | 4/2017 | Okada | B65H 3/0684 |
| 2008/0303204 | A1 * | 12/2008 | Lee | B65H 3/0684 271/121 |
| 2010/0301550 | A1 * | 12/2010 | Muratani | B65H 7/06 271/264 |
| 2012/0193863 | A1 * | 8/2012 | Harada | B65H 3/0684 271/110 |
| 2018/0118480 | A1 * | 5/2018 | Kuriki | B65H 3/063 |

* cited by examiner

SHEET CONVEYOR AND IMAGE FORMING APPARATUS

CROSS-REFERENCE TO RELATED APPLICATION

This application claims priority from Japanese Patent Application No. 2017-056513 filed on Mar. 22, 2017, the content of which is incorporated herein by reference in its entirety.

FIELD OF DISCLOSURE

The disclosure relates to a sheet conveyor for conveying sheets supported on a sheet tray, and to an image forming apparatus including such a sheet conveyor.

BACKGROUND

A known sheet conveyor includes a sheet tray configured to support sheets thereon, a pickup roller configured to feed sheets from the sheet tray, and a separator configured to separate the sheets one from another. The known sheet conveyor further includes a sheet stopper configured to stop the sheets supported on the sheet tray from entering the separator.

The known sheet conveyor further includes a registration roller disposed downstream of the sheet stopper to correct a skew of the separated sheet relative to a sheet conveying direction, and a first sheet sensor disposed upstream of the registration roller in the sheet conveying direction to detect a leading edge of the sheet conveyed.

SUMMARY

When a sheet supported on a sheet tray collide with a sheet stopper, a leading edge of the sheet may be bent or dented. If a first sheet sensor detects a dented leading edge of the sheet, the detection timing may be delayed by a dented amount of the leading edge of the sheet, as compared with a case where the first sheet sensor detects a normal edge of a sheet. This may delay the subsequent process for the conveyed sheet.

It may be beneficial to provide a sheet conveyor in which a sheet sensor detects with improved accuracy a leading edge of a sheet conveyed after a stopper stops the sheet.

According to one or more aspects of the disclosure, a sheet conveyor comprises a sheet tray configured to support a sheet thereon, a sheet stopper including a stopper piece configured to receive and temporarily stop the sheet supported on the sheet tray, a pickup roller configured to convey the sheet from the sheet tray in a sheet conveying direction, a registration roller disposed downstream of the sheet stopper in the sheet conveying direction, a first sheet sensor disposed upstream of the registration roller and downstream of the stopper piece in the sheet conveying direction and configured to detect a leading edge of the sheet, and a second sheet sensor disposed downstream of the registration roller in the sheet conveying direction and configured to detect the leading edge of the sheet. The first sheet sensor includes a first contact member configured to receive the leading edge of the sheet. The second sheet sensor includes a second contact member configured to receive the leading edge of the sheet. The stopper piece of the sheet stopper, the first contact member of the first sheet sensor, and the second contact member of the second sheet sensor are offset from each other in a direction perpendicular to the sheet conveying direction and unaligned with each other in the sheet conveying direction.

According to one or more aspects of the disclosure, an image forming apparatus comprises a sheet conveyor and an image forming unit configured to form an image on a sheet conveyed by the sheet conveyor. The sheet conveyor comprises a sheet tray configured to support a sheet thereon, a sheet stopper including a stopper piece configured to receive and temporarily stop the sheet supported on the sheet tray, a pickup roller configured to convey the sheet from the sheet tray in a sheet conveying direction, a registration roller disposed downstream of the sheet stopper in the sheet conveying direction, a first sheet sensor disposed upstream of the registration roller and downstream of the stopper piece in the sheet conveying direction and configured to detect a leading edge of the sheet, and a second sheet sensor disposed downstream of the registration roller in the sheet conveying direction and configured to detect the leading edge of the sheet. The first sheet sensor includes a first contact member configured to receive the leading edge of the sheet. The second sheet sensor includes a second contact member configured to receive the leading edge of the sheet. The stopper piece of the sheet stopper, the first contact member of the first sheet sensor, and the second contact member of the second sheet sensor are offset from each other in a direction perpendicular to the sheet conveying direction and unaligned with each other in the sheet conveying direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, an illustrative embodiment of the disclosure will be described with reference to the accompanying drawings.

<Overall Configuration of Image Forming Apparatus>

Figure 1:
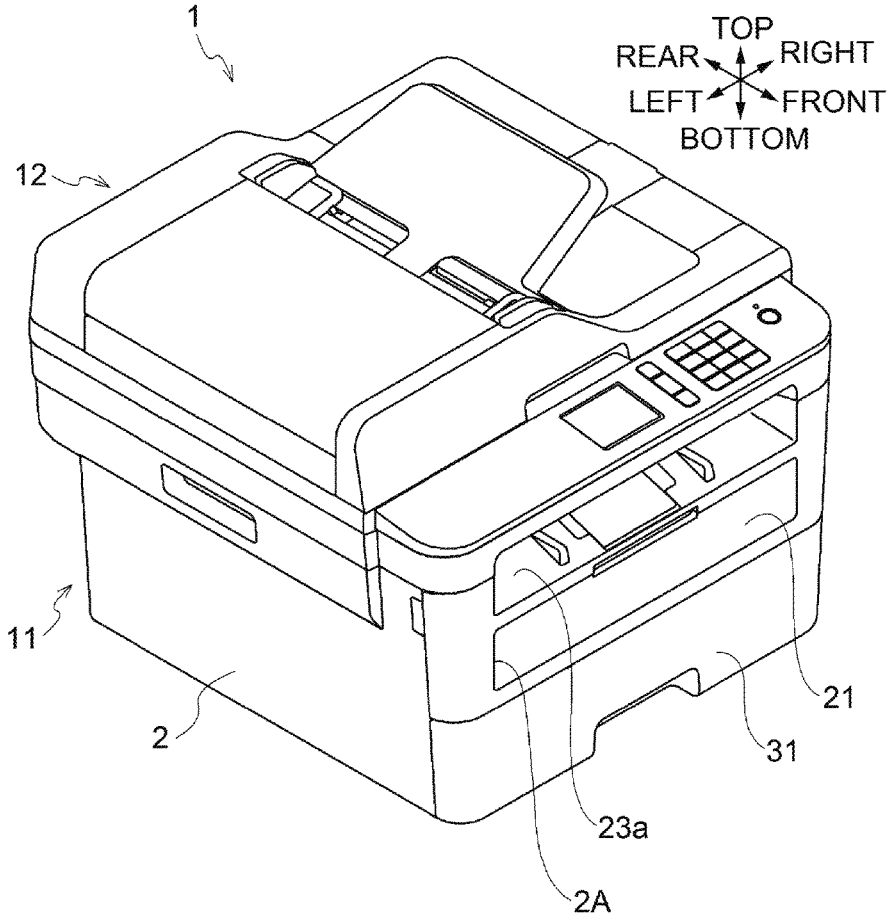
FIG. 1 is a perspective view of an image forming apparatus including a sheet conveyor, in an illustrative embodiment according to one or more aspects of the disclosure.
Figure 2:
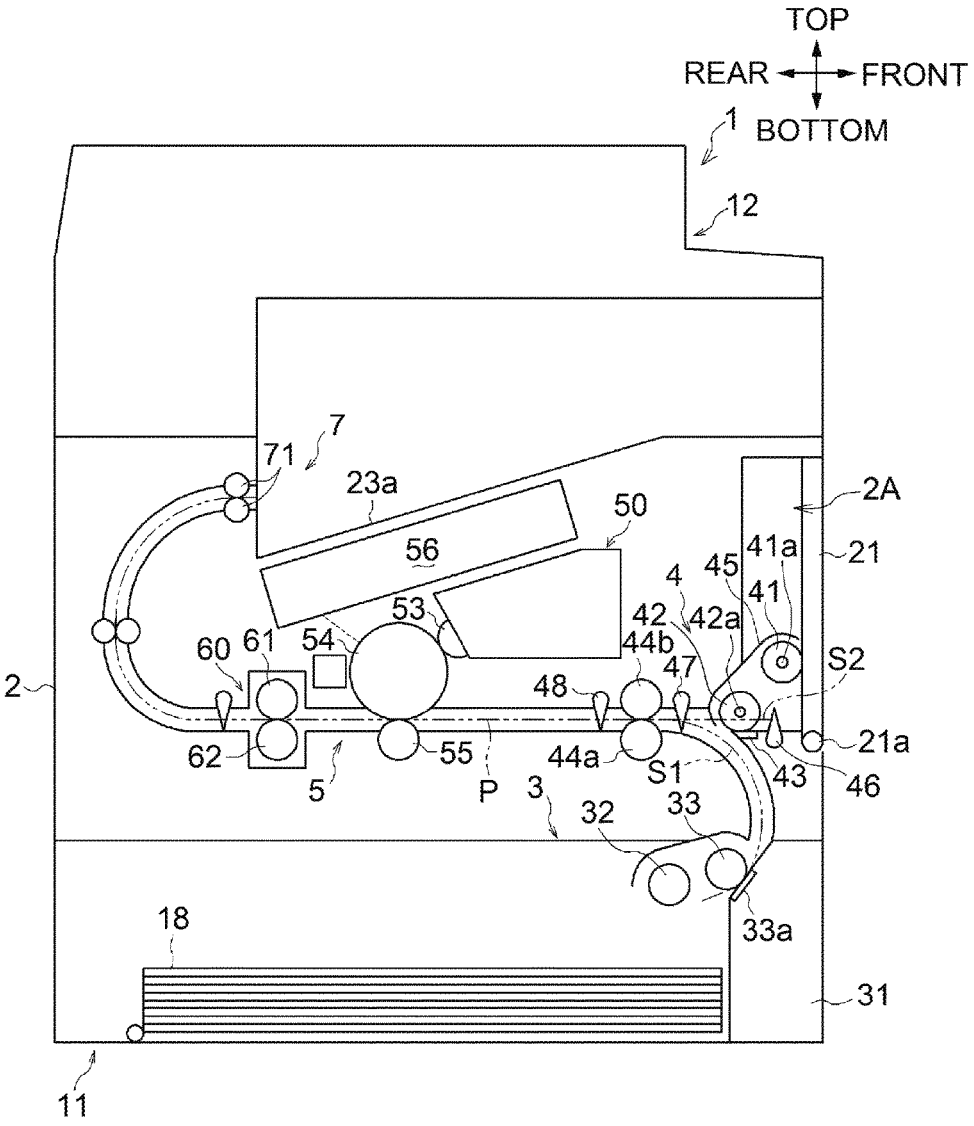
FIG. 2 is a central cross-sectional view of the image forming apparatus with a multipurpose (MP) tray located at a closed position, in the illustrative embodiment.
Figure 3:
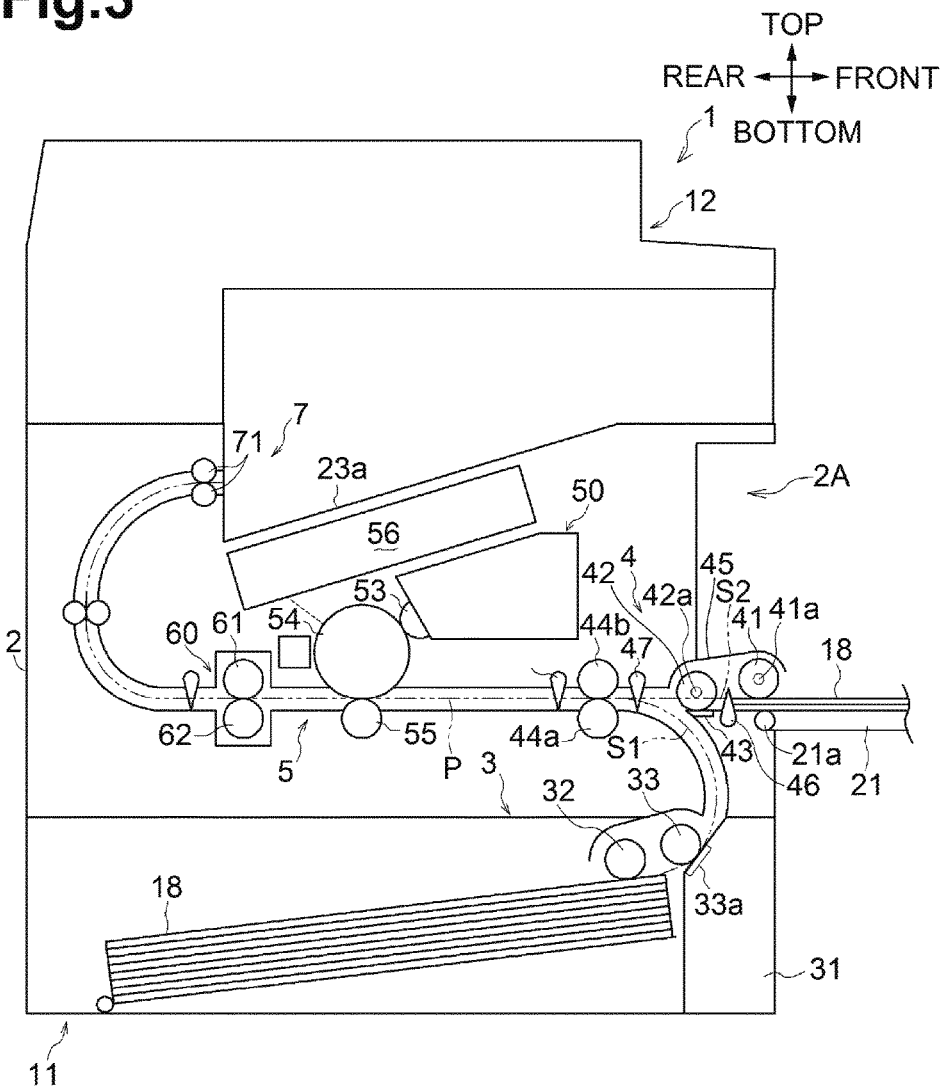
FIG. 3 is a central cross-sectional view of the image forming apparatus with a multipurpose (MP) tray located at an open position, in the illustrative embodiment.

As shown in FIGS. 1 to 3, an image forming apparatus 1 includes a sheet conveyor, in an illustrative embodiment according to one or more aspects of the disclosure. The image forming apparatus 1 integrally includes a printer 11 configured to form an image on a sheet 18, and a scanner 12 disposed above the printer 11 and configured to scan a document. As shown 1, a front-rear direction, a right-left direction, and a top-bottom direction may be defined with reference to an orientation of the image forming apparatus 1 that may be disposed in an orientation in which it may be intended to be used.

The printer 11 includes a housing 2, an image forming unit 5 configured to form an image on a sheet 18, a sheet feeder 3 configured to feed a sheet 18 from the sheet cassette 31 to the image forming unit 5, and a sheet conveyor 4 configured to convey a manually inserted sheet 18 toward the image forming unit 5.

A housing 2 is a box having a substantially rectangular parallelepiped shape and houses therein the sheet feeder 3, the image forming unit 5, and a sheet discharge unit 7. The housing 2 has an opening 21 open to the front and includes a multipurpose tray 21 (hereinafter referred to as a MP tray) configured to open and close the opening 2A. The MP tray 21 is an example of a sheet tray configured to support manually inserted sheets 18.

The MP tray 21 is pivotable about a pivot shaft 21*a* located at a lower end of the MP tray 21 and extending horizontally in the right-left direction. The MP tray 21 is pivotable between a closed position at which the MP tray 21 closes the opening 2A, and an open position at which the MP tray 21 opens the opening 2A. The MP tray 21 at the open position receives manually-inserted sheets 18. A discharge tray 23*a* is formed, at the top of the housing 2, as a recess inclined downward from the front toward the rear.

The sheet feeder 3 includes a sheet cassette 31, a sheet feed roller 32, a separation roller 33, a separation pad 33*a*, and a pair of registration rollers 44*a*, 44*b*. The housing 2 defines therein a first feed path S1 extending from the sheet feed roller 32 to the registration rollers 44*a*, 44*b*, and a conveying path P extending from the registration rollers 44*a*, 44*b*, via the image forming unit 5, to the discharge tray 23*a*.

The sheet cassette 31 is accommodates therein a stack of sheets 18. The sheet feed roller 32 feeds sheets 18 from the sheet cassette 31 toward the separation roller 33. The separation roller 33 and the separation pad 33*a* separate the sheets 18 one from another and feed a separated sheet 18 downstream in a sheet conveying direction along the first feed path S1.

The registration rollers 44*a*, 44*b*, which are disposed downstream of the separation roller 33, conveys the sheet 18 fed along the first feed path S1, toward the image forming unit 5 along the conveying path P. The registration rollers 44*a*, 44*b* temporarily stop a leading edge of the sheet 18 from moving further, and convey the sheet 18 at a predetermined timing toward a transfer position in the image forming unit 5. The registration rollers 44*a*, 44*b* correct a skew of the sheet 18 by temporarily stopping the sheet 18.

The image forming unit 5 is disposed above the sheet cassette 31 and includes a process cartridge 50, an exposure unit 54, and a fixing unit 60. The process cartridge 50 transfers an image onto the sheet 18 fed from the sheet feeder 3. The exposure unit 56 irradiates laser light to a surface of a photosensitive drum 54. The fixing unit 60 fixes the transferred image onto the sheet 18.

The process cartridge 50 includes a developing roller 53, the photosensitive drum 54, and a transfer roller 55. The exposure unit 56 includes a laser diode, a polygon mirror, lenses, and reflectors, and emits laser light toward the photosensitive drum 54 to irradiate laser light to a surface of the photosensitive drum 54.

The photosensitive drum 54 is disposed adjacent to the developing roller 53. After a charger (not shown) uniformly and positively charges a surface of the photosensitive drum 54, the exposure unit 56 irradiates laser light to the surface of the photosensitive drum 54. An irradiated portion of the photosensitive drum 54 decreases, in electric potential, as compared with a non-irradiated portion. Thus, an electrostatic latent image is formed on the photosensitive drum 54 based on image data. When the developing roller 53 supplies positively charged toner to the surface of the photosensitive drum 54 on which the electrostatic latent image is formed, the electrostatic latent image is converted to a visible toner image.

A bias applying unit (not shown) applies a negative transfer bias to the transfer roller 55 which is disposed facing the photosensitive drum 54. In a state where the transfer bias is applied to the surface of the transfer roller 55, the photosensitive drum 54 having the toner image formed thereon and the transfer roller 55 convey the sheet 18 while pinching the sheet 18 therebetween. Consequently, the toner image is transferred to a surface of the sheet 18.

The fixing unit 60 includes a heat roller 61 and a pressure roller 62. The heat roller 61 is driven to rotate by a motor (not shown) of the printer 11 and heated with electricity supplied from a power source (not shown). The pressure roller 62 is disposed facing the heat roller 61 and is rotated by the heat roller 61 while being in close contact with the heat roller 61. The heat roller 61 and the pressure roller 62 convey the sheet 18 having the toner image transferred thereon while pinching the sheet 18 therebetween, thereby fixing the toner image onto the sheet 18.

The discharge unit 7 includes a pair of discharge rollers 71, 71 and discharges the sheet 18 conveyed from the fixing unit 60 to an exterior of the housing 2. Specifically, the discharge rollers 71, 71 discharge the sheet 18 conveyed from the fixing unit 60 to the discharge tray 23*a*.

As shown in FIGS. 2 to 3, the sheet conveyor 4 is disposed at the opening 2A of the housing 2 to convey sheets 18 manually placed on the MP tray 21 toward the image forming unit 5.

<Sheet Conveyor>

The sheet conveyor 4 will now be described. As shown in FIGS. 2 and 3, the sheet conveyor 4 includes the MP tray 21 configured to support sheets 18, a pickup roller 41 configured to rotate in contact with the sheets 18 supported on the MP tray 21 and convey the sheets 18 in a sheet conveying direction, a separation roller 42 disposed downstream of the pickup roller 41 in the sheet conveying direction, a separation pad 43 disposed facing the separation roller 42, a roller holder 45 supporting the pickup roller 41, and the registration rollers 44*a*, 44*b* disposed downstream of the separation roller 42 in the sheet conveying direction.

The separation roller 42 is supported by the housing 2 rotatably about a rotation shaft 42*a* and is driven by a motor (not shown) provided as a driving source in the housing 2. A driving force from the motor is transmitted from the separation roller 42 to the pickup roller 41 via a gear train disposed therebetween. The separation roller 18 and the separation pad 43 separate the sheets 18 conveyed by the pickup roller 41 one from another and convey a separated sheet 18 downstream in the sheet conveying direction.

The roller holder 45 is supported pivotably about the rotation shaft 42*a* of the separation roller 42 and supports the pickup roller 41 rotatably about its rotation shaft 41*a*. When the roller holder 45 pivots about the rotation shaft 42*a* of the separation roller 42, the pickup roller 41 rotates about the rotation shaft 42*a* integrally with the roller holder 45.

The pickup roller 41, the separation roller 42, and the roller holder 45 are disposed at a central portion of a second feed path S2 in an extending direction of the rotation shaft 41*a*, e.g., in the right-left direction. The rotation shaft 41*a* and the rotation shaft 42*a* are disposed parallel to each other. The sheet conveyor 4 defines therein the second feed path S2 extending from the pickup roller 41 to the registration rollers 44*a*, 44*b*.

The sheet conveyor 4 further includes a sheet stopper 46, a first sheet sensor 47, a second sheet sensor 48. The sheet stopper 46 temporarily stops, at a sheet stopping position, the sheets 18 supported on the MP tray 21. The first sheet sensor 47 is disposed upstream, in the sheet conveying direction, of the registration rollers 44*a*, 44*b* and downstream of the sheet stopping position of the sheet stopper 46. The first sheet sensor 47 detects a leading edge of a conveyed sheet 18. The second sheet sensor 48 is disposed downstream of the registration rollers 44*a*, 44*b* in the sheet conveying direction to detect a leading edge of a conveyed sheet 18. The registration rollers 44*a*, 44*b* are disposed downstream of the sheet stopper 46 in the sheet conveying direction.

In the printer 11, the registration rollers 44*a*, 44*b* temporarily stop the sheet 18 upon detection of a leading edge of the sheet 18 by the first sheet sensor 47. The first sheet sensor 47 detects leading and trailing edges of the sheet 18 in order for the printer 11 to calculate a length of the sheet 18 in the sheet conveying direction. The second sheet sensor 48 detects the leading edge of the sheet 18 in order for the printer 11 to determine the timing for irradiating the sheet 18 conveyed toward the image forming unit 5.

As shown in FIGS. 4 to 10, the sheet stopper 46 is disposed on one side of the pickup roller 41 in a direction perpendicular to the sheet conveying direction, e.g., in the right-left direction. In this embodiment, the sheet stopper 46 is disposed to the left of the pickup roller 41.

The sheet stopper 46 includes a stopper piece 461, a pivot shaft 462, a third actuator 463, and a third detector 464. The stopper piece 461 stops the sheets 18 supported on the MP tray 21. The stopper piece 461 pivots about the pivot shaft 462 which is supported by the housing 2. The third actuator 463 is pivotable integrally with the pivot shaft 462. The pivot shaft 462 is parallel to the rotation shaft 41*a* of the pickup roller 41.

The stopper piece 461 is disposed at a substantially same position as the pickup roller 41 in the sheet conveying direction and disposed adjacent to and to the left of the pickup roller 41 in the right-left direction. The pivot shaft 462 extends leftward from the stopper piece 461. The third actuator 463 is fixed to the left end of the pivot shaft 462.

The stopper piece 461 is disposed in close proximity to the pickup roller 41 in the direction perpendicular to the sheet conveying direction. Even when any sheet 18 is supported on the MP tray 21 in a skewed manner relative to the sheet conveying direction, the sheet 18 stopped by the stopper piece 461 is unlikely to enter the pickup roller. Thus, a sheet jam may be prevented.

Figure 8:
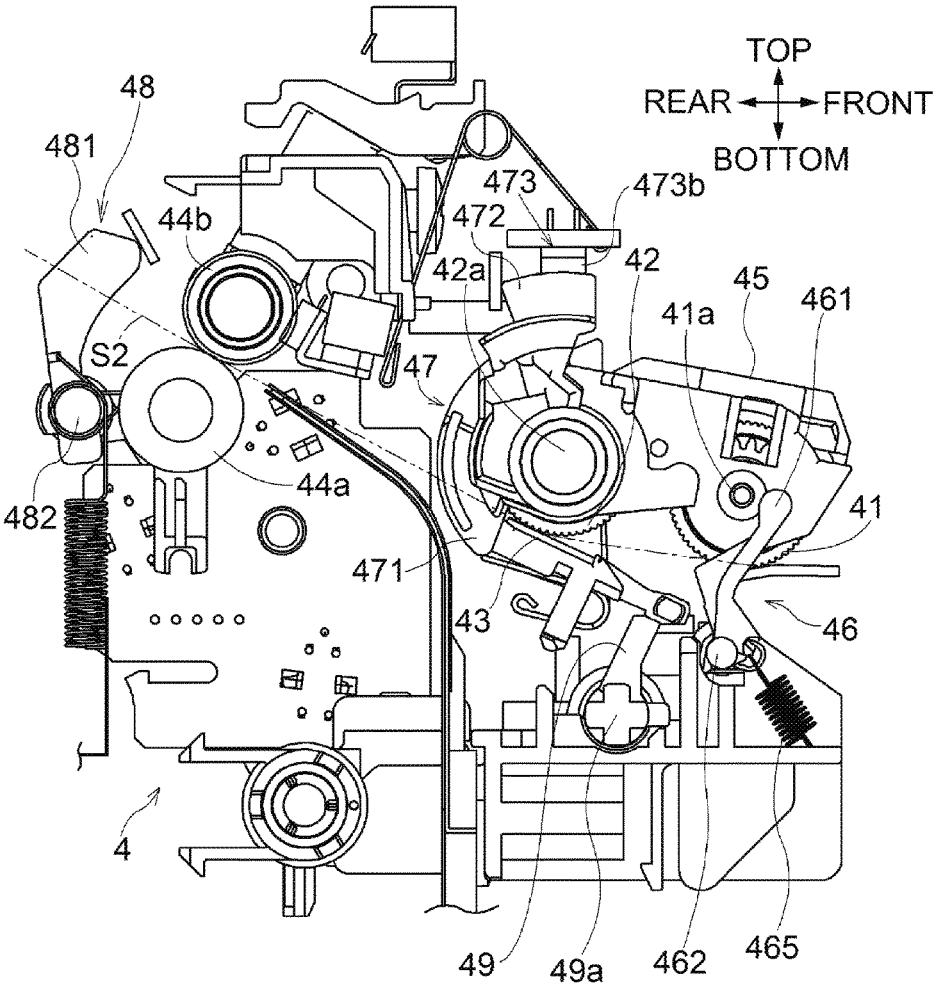
FIG. 8 is a left side cross-sectional view of the sheet conveyor with a stopper piece located at a first position, in the illustrative embodiment.
Figure 9:
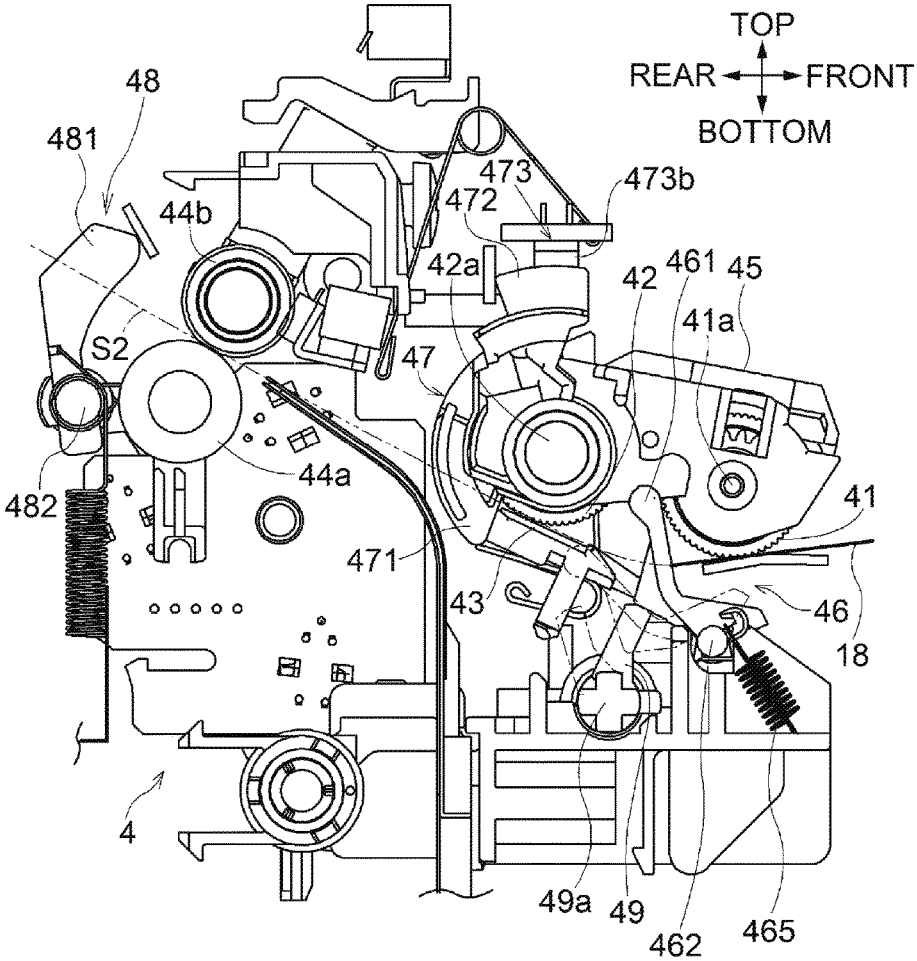
FIG. 9 is a left side cross-sectional view of the sheet conveyor with the stopper piece located at a second position, in the illustrative embodiment.
Figure 10:
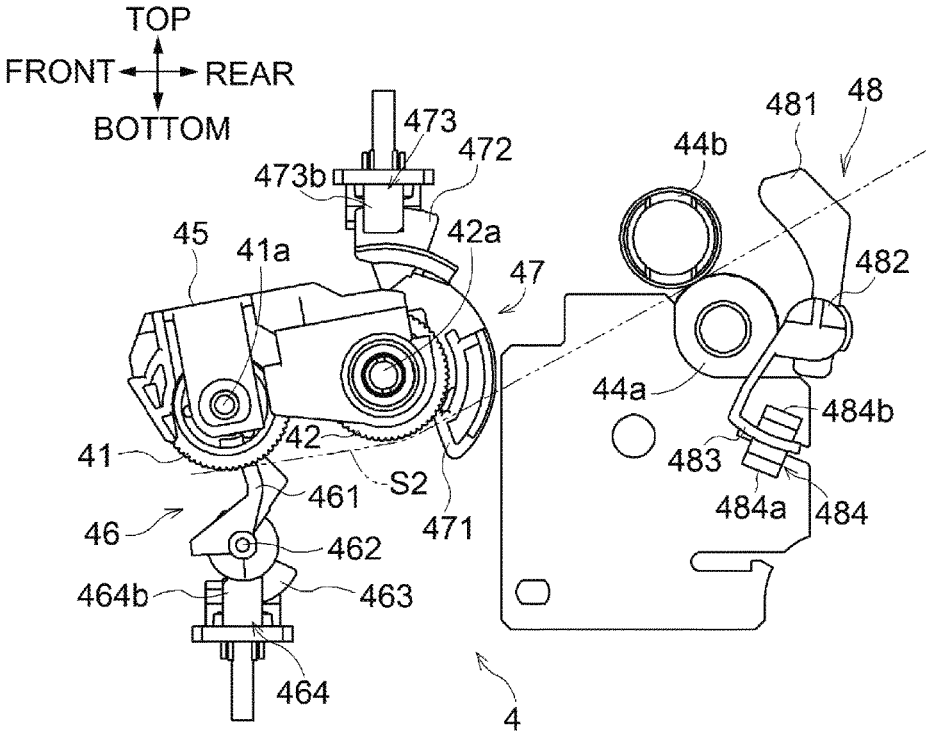
FIG. 10 is a right side cross-sectional view of the sheet conveyor in the illustrative embodiment.

The stopper piece 461 is pivotable about the pivot shaft 462. As shown in FIGS. 8 and 9, the sheet stopper 46 includes a spring 465 which urges the stopper 461 to pivot toward the MP tray 21 (e.g., frontward).

When no sheet 18 is supported on the MP tray 21, the stopper piece 461 is located at a first position (shown in FIG. 8) due to an urging force of the spring 465. When a sheet 18 is supported on the MP tray 21 and is not conveyed by the sheet conveyor 4, a leading edge of the sheet 18 contacts the stopper piece 461 and pivots the stopper piece 461 against the urging force to a second position (shown in FIG. 9 by a solid line). The stopper piece 461 located at the second position stops the sheet 18 supported on the MP tray 21 from moving further toward the separation roller 42.

A lock 49 is disposed downstream of the stopper piece 461 in the sheet conveying direction. The lock 49 is pivotable about a pivot shaft 49*a* between a lock position and a release position. The lock 49, when at the lock position, is in contact with the stopper piece 461 and locks the stopper piece 461 from pivoting from the second position toward the separation roller 42. The lock 49, when at the release position, is out of contact with the stopper piece 461 and allows the stopper piece 461 to pivot from the second position to a third position which is closer to the separation roller 42 than the second position.

The lock 46 located at the lock position is shown in FIG. 9 by a solid line, the lock 46 located at the release position is shown in FIG. 9 by a single-dotted and dashed line. The stopper piece 461 located at the third position is shown in FIG. 9 by a double-dotted and dashed line.

Unless the sheet conveyor 4 conveys a sheet 18, the lock 49 is located at the lock position. When a sheet 18 is placed on the MP tray 21, the lock 49 maintains the stopper piece 461 at the second position at which the stopper piece 461 stops the sheet 18. When the sheet conveyor 4 conveys the sheet 18, the lock 49 is located at the release position and allows the stopper piece 461 to pivot toward the separation roller 42.

The third detector 464 is a third photo-interrupter including a third light emitter 464*a* configured to emit light, and a third light receiver 464*b* configured to receive the light emitted from the third light emitter 464*a*. The third actuator 463 is pivotable integrally with the stopper piece 461 about the pivot shaft 462 into a space between the third light emitter 464*a* and the third light receiver 464*b*.

When the stopper piece 461 is located at the first position, the third actuator 463 is not located between the third light emitter 464*a* and the light receiver 464*b*. When the stopper 461 is located at the second position, the third actuator 463 is located between the third light emitter 464*a* and the third light receiver 464*b*.

Unless the third actuator 463 is located between the third light emitter 464*a* and the third light receiver 46*b*, the third light receiver 464*b* receives light emitted from the third light emitter 464*a*. In this case, the third detector 464 does not detect a sheet 18 supported on the MP tray 21.

When the third actuator 463 is located between the third light emitter 464*a* and the third light receiver 46*b*, light emitted from the third light emitter 464*a* is blocked by the third actuator 463 and is not received by the third light receiver 464*b*. In this case, the third detector 464 detects a sheet 18 supported on the MP tray 21. The third detector 464 and the third actuator 463 constitute a third sheet sensor for detecting whether a sheet 18 is present on the MP tray 21.

The sheet stopper 46 includes the third actuator 463 which changes a state detected by the third sheet sensor. The third sheet sensor operates in response to movement of the sheet stopper 46 and thus detects whether a sheet 18 is supported on the MP tray 21 with an improved accuracy.

The first sheet sensor 47 is pivotable about the rotation shaft 42*a* of the separation roller 42 and includes a first contact member 471, a first actuator 472, and a first detector 473. A leading edge, i.e., a downstream edge of a sheet 18 fed along the second feed path S2 contacts the first contact member 471. The first actuator 472 is pivotable about the rotation shaft 42*a* of the separation roller 42 integrally with the first contact member 471.

The first contact member 471 of the first sheet sensor 47 is disposed to the left of the stopper piece 461 of the sheet stopper 46. In other words, the first sheet sensor 47 is disposed opposite to the pickup roller 41 relative to the stopper piece 46 in a direction perpendicular to the sheet conveying direction. This prevents the first sheet sensor 47 and the pickup roller 41 from interfering with each other in the sheet conveying direction and may downsize the sheet conveyor 4 in the sheet conveying direction.

Unless a leading edge of a sheet 18 fed along the second feed path S2 is in contact with the first contact member 471, the first contact member 471 is located at a pivoted position (shown in FIG. 8) at which the first contact member 471 extends into the second feed path S2. When the leading edge of the sheet 18 fed along the second feed path S2 contacts the first contact member 471, the first contact member 471 pivots clockwise from the pivoted position (shown in FIG. 8) to retract from the second feed path S2. At this time, the first actuator 472 pivots clockwise from a position shown in FIG. 8 integrally with the first contact member 471.

The first detector 473 is a first photo-interrupter including a first light emitter 473*a* configured to emit light, and a first light receiver 473*b* configured to receive the light emitted from the first light emitter 473*a*. The first actuator 472 is pivotable about the pivot shaft 42*a* into a space between the first light emitter 473*a* and the first light receiver 473*b*.

When a leading edge of a sheet 18 is out of contact with the first contact member 471, the first actuator 472 is located at a position between the first light emitter 473*a* and the first light receiver 473*b*. When the leading edge of the sheet 18 contacts the first contact member 471, the first actuator 472 moves away from the position between the first light emitter 473*a* and the first light receiver 473*b*.

When the first actuator 472 is located between the first light emitter 473*a* and the first light receiver 473*b*, light emitted from the first light emitter 473*a* is blocked by the first actuator 472 and is not received by the first light receiver 473*b*. At this time, the first detector 473 does not detect a leading edge of a sheet 18. Unless the first actuator 472 is located between the first light emitter 473*a* and the first light receiver 473*b*, the first light receiver 473*b* receives light emitted from the first light emitter 473*a*. At this time, the third detector 464 detects a leading edge of a sheet 18.

As described above, the first sheet sensor 47 detects pivoting of the first actuator 472 without contact between the first actuator 472 and the first detector 473. The first actuator 472 and the first detector 473, which are out of contact with each other, generate no frictional force therebetween. Thus, the first actuator 472 pivots with a relatively small force applied by a leading edge of a sheet 18 making contact with the first contact member 471. The sheet 18 is unlikely to be dented or damaged upon such contact. In addition, the first detector 473 is not damaged by any friction with the first actuator 472, thereby improving durability of the entire sheet sensor 47.

The second sheet sensor 48 includes a rotation shaft 482, a second contact member 481, and, a second actuator 482, and a second detector 484. The rotation shaft 482 is rotatably supported by the hosing 2. A leading edge, i.e., a downstream edge of a sheet 18 fed along the second feed path S2 contacts the second contact member 481 which is pivotable about the rotation shaft 482. The second actuator 483 is pivotable integrally with the rotation shaft 482. The rotation shaft 482 is parallel to the rotation shaft 41*a* of the pickup roller 41.

Figure 4:
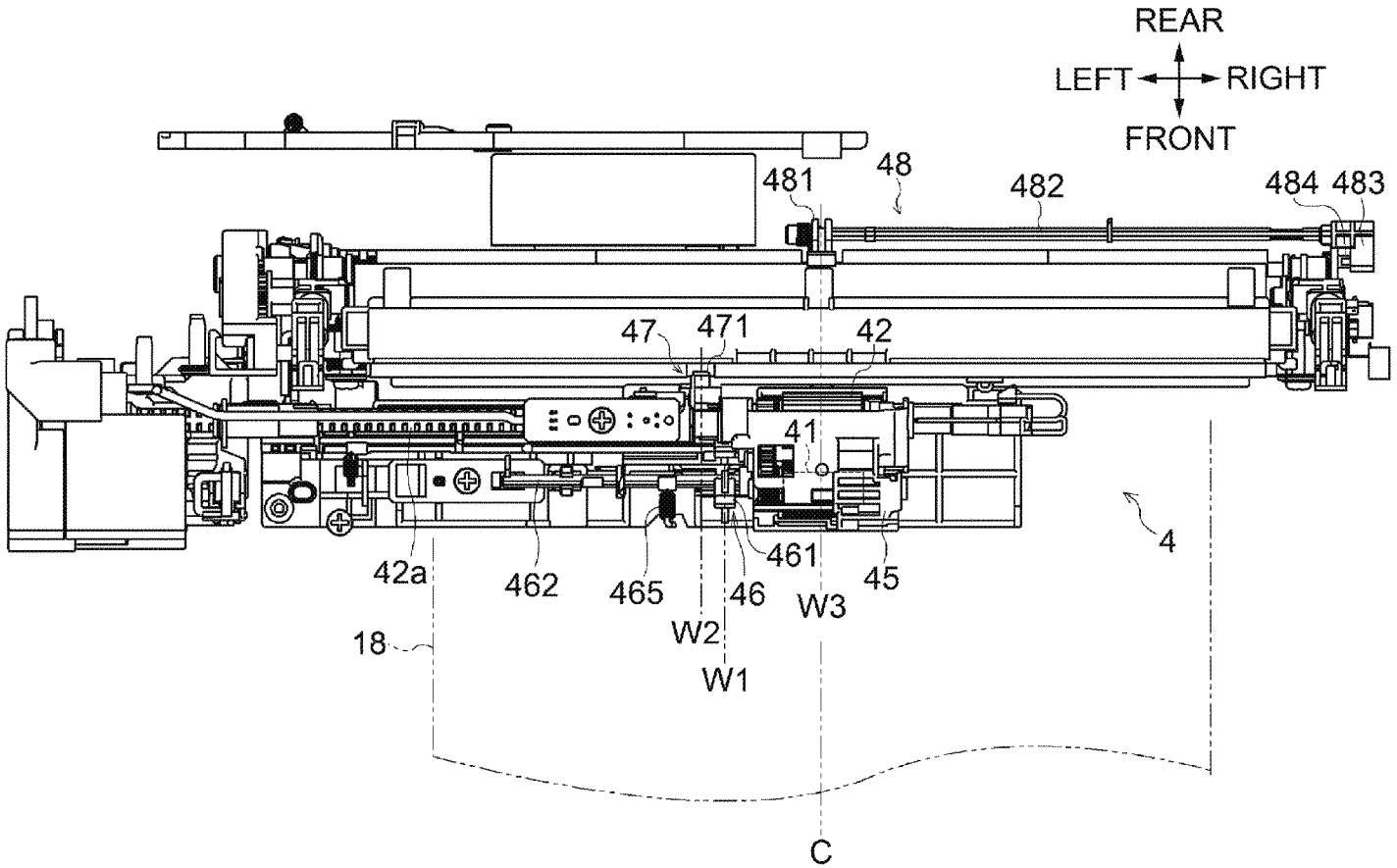
FIG. 4 is a plan view of the sheet conveyor in the illustrative embodiment.

The second contact member 481 of the second sheet sensor 48 is disposed at a central portion of the second feed path S2 in the right-left direction. As shown in FIG. 4, a position W3 of the second contact member 481 in the right-left direction is aligned with a centerline C, with respect to the right-left direction, of a sheet 18 being conveyed. This allows the second sheet sensor to accurately detect a leading edge of a sheet 18 of even a smallest size conveyable by the sheet conveyor 4.

The pivot shaft 482 extends rightward from the second contact member 481. The second actuator 483 is fixed to a right end of the second actuator 484 and disposed at a right end portion of the housing 2.

When a leading edge of a sheet 18 is out of contact with the second contact member 481, the second contact member 481 is located at a pivoted position (in FIG. 8) at which the second contact member 481 protrudes into the second conveying path S2. When the leading edge of the sheet 18 contacts the second contact member 481, the second contact member 481 pivots counterclockwise from the pivoted position shown in FIG. 8 and retracts from the second feed path S2. At this time, the second actuator 483 pivots counterclockwise in FIG. 8 integrally with the second contact member 481.

The second detector 484 is a second photo-interrupter including a second light emitter 484*a* configured to emit light, and a second light receiver 484*b* configured to receive the light emitted from the second light emitter 484*a*. The second actuator 483 is pivotable about the pivot shaft 482 into a space between the second light emitter 484*a* and the second light receiver 484*b*.

When a leading edge of a sheet 18 is out of contact with the second contact member 481, the second actuator 483 is located at a position between the second light emitter 484*a* and the second light receiver 484*b*. When the leading edge of the sheet 18 contacts the second contact member 483, the second actuator 483 moves away from the position between the second light emitter 484*a* and the second light receiver 484*b*.

When the second actuator 483 is located between the second light emitter 484*a* and the second light receiver 484*b*, light emitted from the second light emitter 484*a* is blocked by the second actuator 483 and is not received by the second light receiver 484*b*. At this time, the second detector 484 does not detect a leading edge of a sheet 18. Unless the second actuator 483 is located between the second light emitter 484*a* and the second light receiver 484*b*, the second light receiver 484*b* receives light emitted from the second light emitter 484*a*. At this time, the second detector 484 detects a leading edge of a sheet 18.

As described above, the second sheet sensor 48 detects pivoting of the second actuator 483 without contact between the second actuator 483 and the second detector 484. The second actuator 483 and the second detector 484, which are out of contact with each other, generate no frictional force therebetween. Thus, the second actuator 483 pivots with a relatively small force applied a leading edge of a sheet making contact with the second contact member 481. The sheet 18 is unlikely to be dented or damaged by such contact. In addition, the second detector 484 is not damaged by any friction with the second actuator 483, improving durability of the entire sheet sensor 48.

Figure 5:
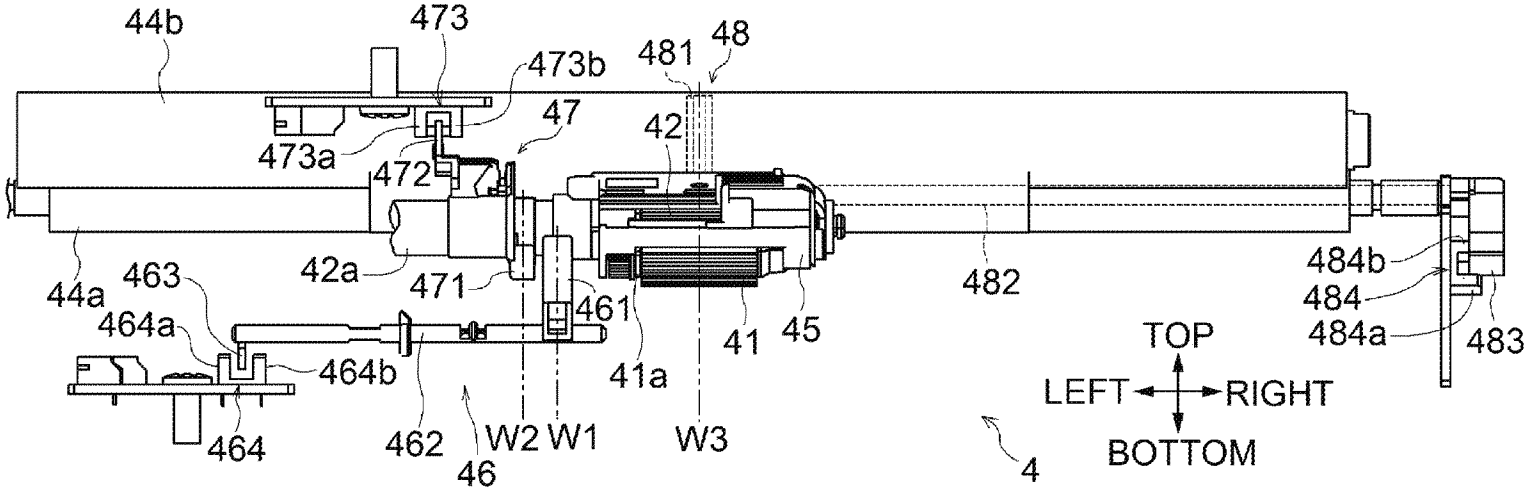
FIG. 5 is a front view of the sheet conveyor in the illustrative embodiment.
Figure 6:
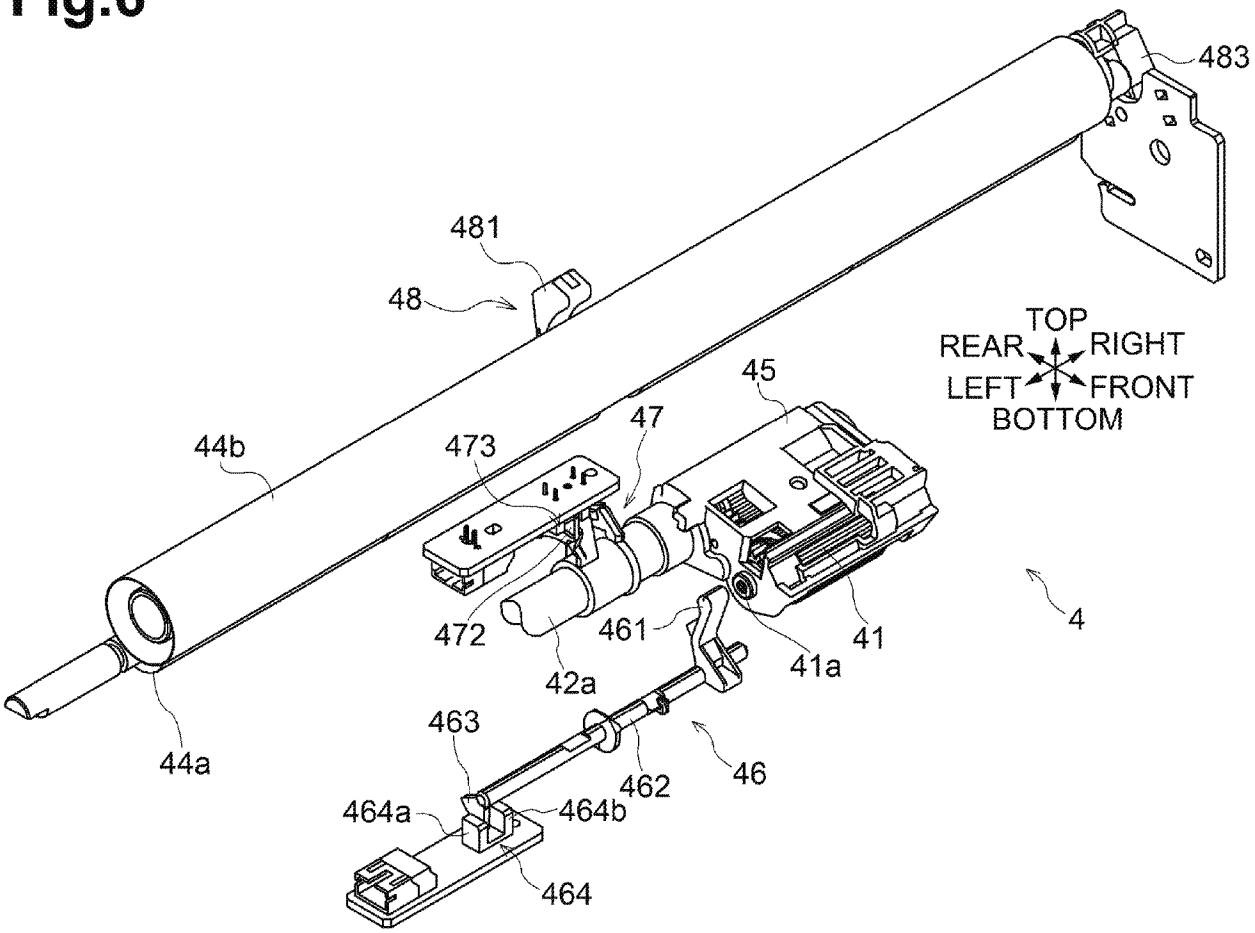
FIG. 6 is a perspective view of the sheet conveyor when viewed diagonally from the left front, in the illustrative embodiment.
Figure 7:
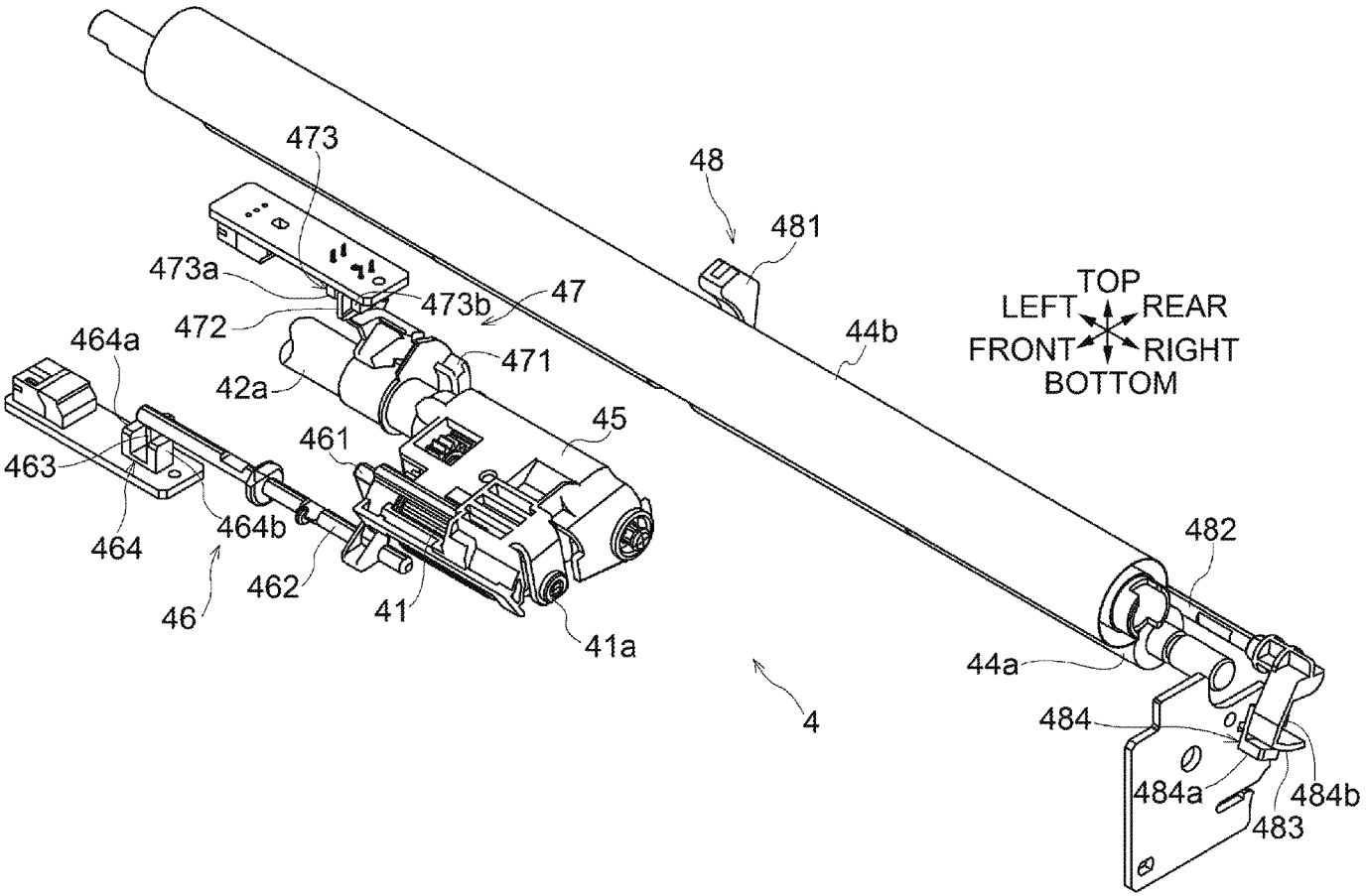
FIG. 7 is a perspective view of the sheet conveyor when viewed diagonally from the right front, in the illustrative embodiment.

In the thus configured sheet conveyor 4, as shown in FIGS. 4 and 5, the stopper piece 461 of the sheet stopper 46, the first contact member 471 of the first sheet sensor 47, and the second contact member 481 of the second sheet sensor 48 are offset from each other in the direction perpendicular to the sheet conveying direction so as not to be aligned with each other in the sheet conveying direction. As shown in FIGS. 4 and 5, in the right-left direction, a position W1 of the stopper piece 461, a position W2 of the first contact member 471, and a position W3 of the second contact member 481 are offset from each other.

When a leading edge of a sheet 18 placed on the MP tray 21 collides with the stopper piece 461, the sheet 18 may be dented at a position colliding with the stopper piece 461. In the sheet conveyor 4, the stopper piece 461, the first contact member 471, and the second contact member 481 are offset from each other in the right-left direction. Thus, even when a collision portion of the leading edge is dented, the first sheet sensor 47 and the second sheet sensor 48 are allowed to detect other portions of the leading edge than the dented portion. This may improve the accuracy in detecting the leading edge of the sheet 18.

Especially, in the sheet conveyor 4, the first contact member 471 of the first sheet sensor 47 is disposed opposite to the pickup roller 41 relative to the stopper piece 461 in the direction perpendicular to the sheet conveying direction. A portion of the leading edge of the sheet 18 which contacts and is stopped by the stopper piece 461 does not pass through a zone where the first contact member 471 is disposed and where the sheet 18 is detected by the first sheet sensor 47.

This may facilitate the first sheet sensor 47 to detect a portion of the sheet 18 other than a portion of the sheet 18 dented upon collision with the stopper piece 461, and may improve the accuracy in detecting the leading edge of the sheet 18. In addition, even when a sheet 18 is supported on the MP tray 21 in an inclined manner relative to the sheet conveying direction, the stopper piece 461 may prevent the sheet 18 from contacting the first sheet sensor. Thus, the first sheet sensor may be prevented from erroneously detecting the sheet 18.

<Effects in the Illustrative Embodiment>

In the illustrative embodiment, the image forming apparatus 1 includes the sheet conveyor 4. The sheet conveyor 4 includes the MP tray 21, the sheet stopper 46, the pickup roller 41, the registration rollers 44*a*, 44*b*, the first sheet sensor 47, and the second sheet sensor 48. When viewed from the upstream toward the downstream in the sheet conveying direction, the stopper piece 461 of the sheet stopper 46, the first contact member 471 of the first sheet sensor 47, and the second contact member 481 of the second sheet sensor 48 are offset from each other in the direction perpendicular to the sheet conveying direction so as not to be aligned with each other in the sheet conveying direction.

This configuration allows the first sheet sensor 47 and the second sheet sensor 48 to detect a portion of a leading edge of a sheet 18 other than a dented portion of the leading edge resulting from collision with the sheet stopper 46. This may improve the accuracy in detecting the leading edge of the sheet 18.

While the disclosure has been described in detail with reference to the specific embodiment, various changes, arrangements and modifications may be applied therein without departing from the spirit and scope of the disclosure.

What is claimed is:

1. A sheet conveyor comprising:

a sheet tray configured to support a sheet thereon;

a sheet stopper including a stopper piece configured to receive and temporarily stop the sheet supported on the sheet tray;

a pickup roller configured to convey the sheet from the sheet tray in a sheet conveying direction;

a registration roller disposed downstream of the sheet stopper in the sheet conveying direction;

a first sheet sensor disposed upstream of the registration roller and downstream of the stopper piece in the sheet conveying direction, and configured to detect a leading edge of the sheet, the first sheet sensor including a first contact member configured to receive the leading edge of the sheet; and a second sheet sensor disposed downstream of the registration roller in the sheet conveying direction and configured to detect the leading edge of the sheet, the second sheet sensor including a second contact member configured to receive the leading edge of the sheet, wherein the stopper piece of the sheet stopper, the first contact member of the first sheet sensor, and the second contact member of the second sheet sensor are offset from each other in a direction perpendicular to the sheet conveying direction and unaligned with each other in the sheet conveying direction.

2. The sheet conveyor according to claim 1, wherein the stopper piece of the sheet stopper is disposed adjacent to the pickup roller in the direction perpendicular to the sheet conveying direction.

3. The sheet conveyor according to claim 1, wherein the first sheet sensor is disposed opposite to the pickup roller relative to the stopper piece of the sheet stopper in the direction perpendicular to the sheet conveying direction.

4. The sheet conveyor according to claim 1, wherein the second contact member of the second sheet sensor is disposed at a position aligned with a centerline, with respect to the direction perpendicular to the sheet conveying direction, of the sheet conveyed by the pickup roller.

5. The sheet conveyor according to claim 1, wherein the first sheet sensor further includes:

a first photo interrupter including a first light emitter configured to emit light, and a first light receiver configured to receive the light emitted by the first light emitter; and a first actuator configured to block the light emitted by the first light emitter.

6. The sheet conveyor according to claim 5, wherein the first contact member of the first sheet sensor is movable upon receiving the leading edge of the sheet, and the first actuator is movable integrally with the first contact member.

7. The sheet conveyor according to claim 1, wherein the second sheet sensor further includes:

a second photo interrupter including a second light emitter configured to emit light, and a second light receiver configured to receive the light emitted by the second light emitter; and a second actuator configured to block the light emitted by the second light emitter.

8. The sheet conveyor according to claim 7, wherein the second contact member of the second sheet sensor is movable upon receiving the leading edge of the sheet, and the second actuator is movable integrally with the second contact member.

9. The sheet conveyor according to claim 1, further comprising a third sheet sensor configured to detect the sheet supported on the sheet tray, wherein the sheet stopper further includes a third actuator configured to change a detecting state of the third sheet sensor.

10. The sheet conveyor according to claim 9, wherein the stopper piece of the sheet stopper is movable upon receiving the sheet, and the third actuator is movable integrally with the stopper piece.

11. The sheet conveyor according to claim 1, wherein the pickup roller is disposed in alignment with a centerline, with respect to the direction perpendicular to the sheet conveying direction, of the sheet conveyed by the pickup roller, and the sheet stopper and the first sheet sensor are disposed off the centerline.

12. An image forming apparatus comprising:

a sheet conveyor comprising:

a sheet tray configured to support a sheet thereon;

a sheet stopper including a stopper piece configured to receive and temporarily stop the sheet supported on the sheet tray;

a pickup roller configured to convey the sheet from the sheet tray in a sheet conveying direction;

a registration roller disposed downstream of the sheet stopper in the sheet conveying direction;

a first sheet sensor disposed upstream of the registration roller and downstream of the stopper piece of the sheet stopper, and configured to detect a leading edge of the sheet, the first sheet sensor including a first contact member configured to receive the leading edge of the sheet; and a second sheet sensor disposed downstream of the registration roller in the sheet conveying direction and configured to detect the leading edge of the sheet, the second sheet sensor including a second contact member configured to receive the leading edge of the sheet, wherein the stopper piece of the sheet stopper, the first contact member of the first sheet sensor, and the second contact member of the second sheet sensor are offset from each other in a direction perpendicular to the sheet conveying direction and unaligned with each other in the sheet conveying direction; and an image forming unit configured to form an image on the sheet conveyed by the sheet conveyor.

* * * * *